US009384756B2

(12) United States Patent
Yamabe et al.

(10) Patent No.: US 9,384,756 B2
(45) Date of Patent: Jul. 5, 2016

(54) CYCLIC NOISE REDUCTION FOR TARGETED FREQUENCY BANDS

(71) Applicant: JVC KENWOOD Corporation, Yokohama-shi, Kanagawa (JP)

(72) Inventors: Takaaki Yamabe, Yokohama (JP); Keisuke Oda, Yokohama (JP)

(73) Assignee: JVC KENWOOD CORPORATION, Yokohama-Shi, Kanagawa (JP)

( * ) Notice: Subject to any disclaimer, the term of this patent is extended or adjusted under 35 U.S.C. 154(b) by 0 days.

(21) Appl. No.: 14/641,070

(22) Filed: Mar. 6, 2015

(65) Prior Publication Data

US 2015/0255085 A1 Sep. 10, 2015

(30) Foreign Application Priority Data

Mar. 7, 2014 (JP) ..... 2014-044482

(51) Int. Cl.
*G10L 21/0208* (2013.01)
*G10L 21/0216* (2013.01)

(52) U.S. Cl.
CPC ..... *G10L 21/0208* (2013.01); *G10L 21/0216* (2013.01); *G10L 2021/02085* (2013.01)

(58) Field of Classification Search
CPC ..... G10L 21/0208; G10L 2021/02085; G10L 21/0216
USPC ..... 704/226–227; 381/71.14
See application file for complete search history.

(56) References Cited

U.S. PATENT DOCUMENTS 5,903,819 A * 5/1999 Romesburg ..... G10K 11/1788 375/285
5,970,156 A * 10/1999 Hummelgaard ..... G10L 25/78 381/94.2

(Continued)

FOREIGN PATENT DOCUMENTS

GB 2341299 A * 3/2000 ..... G10L 21/02
JP 60-033752 A 2/1985

(Continued)

OTHER PUBLICATIONS

Ding, Hui, et al. "An Adaptive Speech Enhancement Method for Siren Noise Cancellation." Applied Acoustics 65.4, Apr. 2004, pp. 385-399.*

(Continued)

*Primary Examiner* — James Wozniak
(74) *Attorney, Agent, or Firm* — Procopio, Cory, Hargreaves & Savitch, LLP

(57) ABSTRACT

A noise elimination device according to the present invention includes a signal separation unit that divides input frequency information generated from an input signal on a time-domain into suppression target band information including a cyclic noise as the main component and intended sound band information including intended sound band information as the main component, a first frequency reverse-conversion unit that converts the suppression target band information into time-domain information and thereby outputs a suppression target signal, a second frequency reverse-conversion unit that converts the intended sound band information into time-domain information and thereby outputs an intended sound signal, and a cyclic noise information storage unit that accumulates the suppression target signal and thereby stores noise history information including information corresponding to at least one cycle of the cyclic noise.

9 Claims, 11 Drawing Sheets

(56) References Cited

U.S. PATENT DOCUMENTS

| | | | | |
|---|---|---|---|---|
| 2002/0180613 | A1* | 12/2002 | Shi | G01V 11/002 340/853.1 |
| 2004/0234079 | A1* | 11/2004 | Schneider | H03G 7/002 381/58 |
| 2004/0242157 | A1* | 12/2004 | Klinke | H04B 1/1036 455/63.1 |
| 2006/0222192 | A1* | 10/2006 | Matthey | H04R 25/00 381/312 |
| 2011/0051954 | A1* | 3/2011 | Thomsen | H03F 3/34 381/93 |
| 2012/0136655 | A1* | 5/2012 | Yamabe | G10L 25/90 704/207 |
| 2014/0350927 | A1* | 11/2014 | Yamabe | G10L 21/0232 704/233 |

FOREIGN PATENT DOCUMENTS

| | | | |
|---|---|---|---|
| JP | 11-232802 | A | 8/1999 |
| JP | 2000-293965 | A | 10/2000 |
| JP | 2002-258899 | A | 9/2002 |
| JP | 2002-367298 | A | 12/2002 |
| JP | 2003-58186 | A | 2/2003 |

OTHER PUBLICATIONS

Ogata, Shinya, et al. "Improved Model of SPAC (Speech Processing System by Use of AutoCorrelation Function) Utilizing Spectral Subtraction as Preprocessing." Proc. of ICA, Sep. 2004, pp. 3037-3040.*

* cited by examiner

GRAPH SHOWING FREQUENCY CHANGES OF SIREN SOUND

GRAPH SHOWING FREQUENCY CHARACTERISTIC IN PREDETERMINED

GRAPH SHOWING FREQUENCY CHANGES OF SIREN SOUND

GRAPH SHOWING FREQUENCY CHARACTERISTIC IN PREDETERMINED

CYCLIC NOISE REDUCTION FOR TARGETED FREQUENCY BANDS

INCORPORATION BY REFERENCE

This application is based upon and claims the benefit of priority from Japanese patent application No. 2014-044482, filed on Mar. 7, 2014, the disclosure of which is incorporated herein in its entirety by reference.

BACKGROUND OF THE INVENTION

1. Field of the Invention

The present invention relates to a noise reduction device, in particular, a noise reduction device that reduces a cyclic noise (also known as periodic noise).

2. Description of Related Art

In mobile communication devices, there is a problem that when a noise is mixed into a voice, which is the intended sound, due to surrounding environments, it is very difficult to obtain the voice. In radio devices, in particular, there is a cyclic noise such as a siren that occurs, for example, when firefighters go to the site of a fire or when they fight against the fire at the site. When a radio device is used while a siren is wailing, the siren sound is mixed into a voice and picked up by the radio device, thus causing a problem that the person on the receiving side can hardly catch the voice. Therefore, Japanese Unexamined Patent Application Publications No. S60-033752, No. 2002-258899, No. 2000-293965, No. 2003-58186, No. 2002-367298, and No. H11-232802 disclose techniques for reducing noises.

Japanese Unexamined Patent Application Publication No. S60-033752 discloses a modified version of a speech processing method SPAC (Speech Processing system by use of an Auto correlation function). In the SPAC, a voice, which is the intended signal, can be emphasized by obtaining a short-time auto-correlation at an interval corresponding to one cycle of an input signal and connecting waveforms each corresponding to one cycle of the correlation function. However, although the ability of the SPAC to reduce random noises is high, the effect of the SPAC for cyclic noises is poor because the SPAC has such a characteristic that periodic waveforms are emphasized. Therefore, Japanese Unexamined Patent Application Publication No. S60-033752 makes it possible to reduce the level of cyclic noises as well as random noises by subtracting a waveform obtained by averaging short-time auto-correlation functions in the process in which a voice waveform is synthesized by connecting waveforms each corresponding to one cycle of the correlation function.

However, under the condition where background noises could be mixed into the voices as in the case of mobile communications, there are cases where one cycle cannot be accurately measured by the auto-correlation function. Therefore, in Japanese Unexamined Patent Application Publication No. S60-033752, there is a possibility that discontinuity between frames occurs in the process for synthesizing a voice waveform by connecting waveforms each corresponding to one cycle of the correlation function, thus causing pulse noises. Accordingly, the technique disclosed in Japanese Unexamined Patent Application Publication No. S60-033752 is not suitable for the use in which background noises could be mixed into the voices.

In Japanese Unexamined Patent Application Publication No. 2002-258899, an input signal in which a siren sound is mixed into a voice signal is converted from a time domain to a frequency domain for each frame having a predetermined time length, and the presence/absence of the siren sound is detected from the frequency domain signal. Then, in Japanese Unexamined Patent Application Publication No. 2002-258899, when a siren sound is present, the basic frequency of the siren sound is extracted and the siren sound is suppressed by suppressing a harmonics component(s) several times higher than the basic frequency. Note that in Japanese Unexamined Patent Application Publication No. 2002-258899, as a method for detecting a siren sound, firstly, a point at which the sum total of the spectra of each frequency and its harmonics is maximized is calculated as a basing frequency. Then, a root-mean-square error between the calculated basic frequency and a siren sound fundamental period pattern that is registered in a memory in advance is calculated. When the root-mean-square error is smaller than a predefined threshold, it is determined that a siren sound is present. On the other hand, when the root-mean-square error is larger than the predefined threshold, it is determined that there is no siren sound.

In Japanese Unexamined Patent Application Publication No. 2000-293965, means for sampling an assumed (or expected) mechanical noise signal(s) and storing the sampled noise signal as a pseudo-noise waveform(s) into a memory such as a nonvolatile memory in advance is provided. Then, the pseudo-noise is read from the nonvolatile memory at the noise pitch of a mechanical noise picked up by a microphone and the read pseudo-noise is subtracted from the input signal. By doing so, the noise is reduced.

In Japanese Unexamined Patent Application Publication No. 2003-58186, a siren sound suppression information setting unit detects the presence/absence of a noise to be suppressed from a signal that is converted into a frequency domain. Then, the noise's basic frequency is extracted and supplied to a siren sound suppression unit. Further, in Japanese Unexamined Patent Application Publication No. 2003-58186, this siren sound suppression unit suppresses a siren sound noise based on this information. In this case, the siren sound suppression unit extracts a basic frequency at an interval corresponding to a predetermined frame, so that the memory capacity necessary in a long-term average spectrum amplitude update unit can be reduced. Further, in Japanese Unexamined Patent Application Publication No. 2003-58186, an output of the siren sound suppression unit is supplied to a stationary noise suppression unit and a stationary noise is thereby suppressed.

Each of Japanese Unexamined Patent Application Publications No. 2002-367298 and No. H11-232802 discloses a technique in which a noise is reduce by generating a pseudo-noise signal having a correlation with a noise component mixed into an information signal by using an adaptive filter based on an energy wave generated by using energy generation means and then subtracting the pseudo-noise signal component from the information signal. Further, when the operating mode of an electronic device changes, the noise component of the information signal changes. Therefore, each of Japanese Unexamined Patent Application Publications No. 2002-367298 and No. H11-232802 also discloses a technique in which convergence speed of the noise cancelling is increased by changing a step gain in and near the operating mode transition period of the electronic device.

SUMMARY OF THE INVENTION

However, the present inventors have found the following problem. The frequency changing speeds of cyclic noises such as siren sounds differ from one another depending on the noise source or the region. In Japanese Unexamined Patent Application Publications No. 2002-258899, No. 2000-

293965, No. 2003-58186, and No. 2002-367298, there is a problem that: in order to cope with a number of types of cyclic noises, it is necessary to prepare information about a number of noise components corresponding to these types of cyclic noises; however, it is very difficult to cope with every one of these cyclic noises.

A first exemplary aspect of the present invention is a noise elimination device including: a frequency conversion unit that converts an input signal in a form of time-domain information into frequency-domain information and thereby outputs input frequency information; a signal separation unit that divides the input frequency information into suppression target band information and intended sound band information, the suppression target band information including information on a frequency band of a cyclic noise mixed in the input signal as a main component, the intended sound band information including information other than the frequency band of the cyclic noise as a main component; a first frequency reverse-conversion unit that converts the suppression target band information into time-domain information and thereby outputs a suppression target signal; a second frequency reverse-conversion unit that converts the intended sound band information into time-domain information and thereby outputs an intended sound signal; a cyclic noise information storage unit that accumulates the suppression target signal and thereby stores noise history information including information corresponding to at least one cycle of the cyclic noise; a noise filter that artificially reproduces the suppression target signal by using the noise history information as a reference signal, and generates a suppression signal having a reverse relation to the suppression target signal and outputs a difference value between the suppression signal and the suppression target signal as a residual signal; and an adder that combines the residual signal with the intended sound signal and thereby generates an output signal.

Another exemplary aspect of the present invention is a noise elimination method in a noise elimination device that suppresses a cyclic noise included in an input signal and outputs an output signal, the noise elimination method including: converting an input signal in a form of time-domain information into frequency-domain information and thereby outputting input frequency information; dividing the input frequency information into suppression target band information and intended sound band information, the suppression target band information including information on a frequency band of a cyclic noise mixed in the input signal as a main component, the intended sound band information including information other than the frequency band of the cyclic noise as a main component; converting the suppression target band information into time-domain information and thereby outputting a suppression target signal; converting the intended sound band information into time-domain information and thereby outputting an intended sound signal; accumulating the suppression target signal and thereby storing cyclic noise information including information corresponding to at least one cycle of the cyclic noise; artificially reproducing the suppression target signal by using the noise history information as a reference signal, and generating a suppression signal having a reverse relation to the suppression target signal and outputting a difference value between the suppression signal and the suppression target signal as a residual signal; and combining the residual signal with the intended sound signal and thereby generating the output signal.

Another exemplary aspect of the present invention is a noise elimination program executed by an arithmetic unit in a noise elimination device, the noise elimination device including the arithmetic unit and a storage unit and being configured to suppress a cyclic noise included in an input signal and output an output signal, the noise elimination program being adapted for causing a computer to execute: a frequency conversion step of converting an input signal in a form of time-domain information into frequency-domain information and thereby outputting input frequency information; a signal separation step of dividing the input frequency information into suppression target band information and intended sound band information, the suppression target band information including information on a frequency band of a cyclic noise mixed in the input signal as a main component, the intended sound band information including information other than the frequency band of the cyclic noise as a main component; a first frequency reverse-conversion step of converting the suppression target band information into time-domain information and thereby outputting a suppression target signal; a second frequency reverse-conversion step of converting the intended sound band information into time-domain information and thereby outputting an intended sound signal; a cyclic noise information storing step of accumulating the suppression target signal and thereby storing cyclic noise information including information corresponding to at least one cycle of the cyclic noise; a noise filtering step of artificially reproducing the suppression target signal by using the noise history information as a reference signal, and generating a suppression signal having a reverse relation to the suppression target signal and outputting a difference value between the suppression signal and the suppression target signal as a residual signal; and an addition step of combining the residual signal with the intended sound signal and thereby generating the output signal.

According to the present invention, a noise elimination device, a noise elimination method, and a noise elimination program capable of achieving a high noise suppression effect irrespective of the type of the cyclic noise are provided.

The above and other objects, features and advantages of the present invention will become more fully understood from the detailed description given hereinbelow and the accompanying drawings which are given by way of illustration only, and thus are not to be considered as limiting the present invention.

DESCRIPTION OF THE EXEMPLARY EMBODIMENTS

First Exemplary Embodiment

Exemplary embodiments according to the present invention are explained hereinafter with reference to the drawings. When a cyclic noise is mixed into an input signal, a noise elimination device 1 according to a first exemplary embodiment outputs an output signal that is obtained by suppressing the cyclic noise from the input signal. Note that the cyclic noise is a noise whose frequency periodically changes. For example, a siren sound generated by a fire engine or the like is considered to be a cyclic noise. In the following explanation, an example in which a siren sound is used as a cyclic noise is shown for simplifying the explanation. However, the cyclic noise is not limited to siren sounds and includes various noises whose frequencies periodically change.

Figure 1:
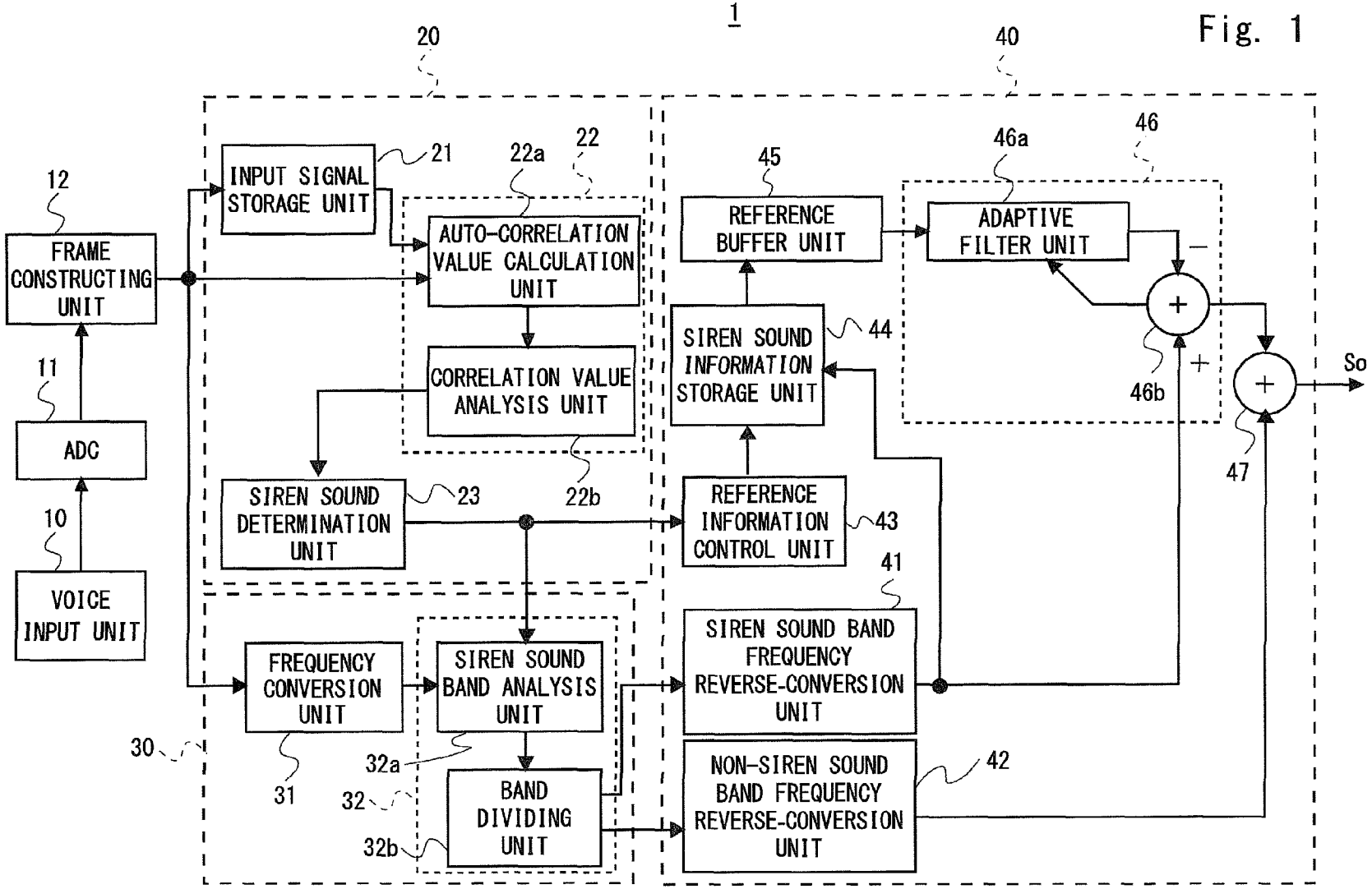
FIG. 1 is a block diagram of a noise elimination device according to a first exemplary embodiment.

FIG. 1 is a block diagram of the noise elimination device 1 according to a first exemplary embodiment. As shown in FIG. 1, the noise elimination device 1 according to the first exemplary embodiment includes a voice input unit 10, an analog-digital converter 11, a frame constructing unit 12, a noise detection unit 20, a conversion separation unit 30, and a noise suppression unit 40.

Note that in the noise elimination device 1, the voice input unit 10 and a storage unit for storing various information items may be constructed by hardware. Further, in the noise elimination device 1, processing performed for information or signals by the noise detection unit 20, the conversion separation unit 30, and the noise suppression unit 40 may be implemented by a program(s) (e.g., a noise elimination program) that is executed by an arithmetic unit such as CPU (Central Processing Unit) or DSP (Digital Signal Processor). In this case, the noise elimination program can be stored in various types of non-transitory computer readable media and thereby supplied to computers. The non-transitory computer readable media includes various types of tangible storage media. Examples of the non-transitory computer readable media include a magnetic recording medium (such as a flexible disk, a magnetic tape, and a hard disk drive), a magneto-optic recording medium (such as a magneto-optic disk), a CD-ROM (Read Only Memory), a CD-R, and a CD-R/W, and a semiconductor memory (such as a mask ROM, a PROM (Programmable ROM), an EPROM (Erasable PROM), a flash ROM, and a RAM (Random Access Memory)). Further, the program can be supplied to computers by using various types of transitory computer readable media. Examples of the transitory computer readable media include an electrical signal, an optical signal, and an electromagnetic wave. The transitory computer readable media can be supplied to a computer including a CPU through a wire communication path such as an electrical wire and an optical fiber, or wireless communication path. Further, each component implemented by a program may be constructed by hardware.

The voice input unit 10 is, for example, a sensor such as a microphone, and externally acquires a voice signal. The voice signal acquired by the voice input unit 10 is an analog signal. The analog-digital converter 11 converts the analog voice signal into a digital signal. The frame constructing unit 12 converts an input signal, which has been converted into a digital value, into frames in units that are determined according to the predefined number of samples. The noise detection unit 20, the conversion separation unit 30, and the noise suppression unit 40 perform a cyclic noise (e.g., siren sound) detection process, a signal separation process, and a noise elimination process for the input signal, which has been converted into the frames.

When the noise detection unit 20 detects that a cyclic noise is included in the current input signal based on the correlation between the current input signal and a preceding input signal(s), which was input prior to the current input signal, the noise detection unit 20 outputs a cyclic noise detection signal including cycle information of the cyclic noise. More specifically, the noise detection unit 20 accumulates input signals as history information and thereby generates a preceding input signal(s), and determines the presence/absence of a siren sound and the cycle of the siren sound based on a correlation between the preceding signal(s) and the current input signal. Then, when the noise detection unit 20 determines that a siren sound is included in the input signal, the noise detection unit 20 sets a siren sound mode signal included in the cyclic noise detection signal to a siren sound lock mode for notifying the conversion separation unit 30 and the noise suppression unit 40 that a siren sound is included in the input signal, and outputs the cycle information of the siren sound to the conversion separation unit 30 and the noise suppression unit 40.

The noise detection unit 20 includes an input signal storage unit 21, an auto-correlation unit 22, and a cyclic noise determination unit (e.g., siren sound determination unit 23). Further, the auto-correlation unit 22 includes an auto-correlation value calculation unit **22*a* and a correlation value analysis unit 22*b***.

The input signal storage unit 21 accumulates input signals and thereby generates a preceding input signal(s). The length of the preceding input signal held by the input signal storage unit 21 may be set to such a length that a time width necessary for obtaining the cyclic nature of a siren sound can be secured. That is, the input signal storage unit 21 adds a newly input input signal to the preceding input signal while discarding the information of the oldest input signal of the preceding input signals, and thereby continuously holds the information of an input signal(s) corresponding to the necessary time width as the information of the preceding input signal.

The auto-correlation unit 22 calculates an auto-correlation value between the current input signal and the preceding input signal, and analyzes the cycle information of an auto-correlation value larger than a predefined auto-correlation threshold. Note that the auto-correlation unit 22 calculates the auto-correlation value between the current input signal and the preceding input signal by using the auto-correlation value calculation unit **22*a*. Further, the correlation value analysis unit 22*b* accumulates auto-correlation values calculated in the auto-correlation value calculation unit 22*a***, analyzes the positions and the intervals of peaks of an auto-correlation value(s) larger than the auto-correlation threshold, and outputs the positions and the intervals of the peaks of the auto-correlation value(s) as cycle information of the siren sound. Note that for the auto-correlation threshold, a positive difference value from the average value of correlation values in a predetermined time width, a value obtained from a predetermined multiplying factor or the like with respect to the average value of correlation values, or the like can be used.

A calculation method for an auto-correlation value performed in the auto-correlation value calculation unit **22*a*** is explained hereinafter. In the first exemplary embodiment, for example, the below-shown Expression (1) can be used as a calculation formula for the auto-correlation value.

[Expression 1]

$$A[m] = \frac{1}{N}\sum_{n=0}^{N-1} x[n]\cdot x[n-m],\ m = 0, 1, \ldots, N-1 \quad (1)$$

In Expression (1), m and n are natural numbers. In particular, m is a value indicating a range (time width) in which an auto-correlation value is calculated from a series of input signals (hereinafter referred to as "input signal series") and corresponds to a phase difference between the current input signal and an input signal included in the preceding input signal. Further, N is a constant corresponding to the maximum phase difference (search range), and n is the number of samples of an input signal series for which an auto-correlation value is calculated. Further, x is an input signal converted into a frame, and A[m] is an auto-correlation value in a phase difference m.

The siren sound determination unit 23 determines whether or not a cyclic noise (e.g., siren sound) is included in the current input signal based on the cycle information. Then, when a cyclic noise is included in the current input signal, the siren sound determination unit 23 outputs the cycle information to a reference information control unit 43 of the noise suppression unit 40. The siren sound determination unit 23 makes the following decision when it determines whether or not a siren sound is included in the current input signal.

Firstly, the siren sound determination unit 23 determines whether or not there are peaks of an auto-correlation value (e.g., auto-correlation values equal to or larger than an auto-correlation threshold) at regular intervals by referring to the cycle information. Next, when it is determined that there are peaks of an auto-correlation value at regular intervals, the siren sound determination unit 23 determines there is a peak of other auto-correlation values between those peaks located at regular intervals (hereinafter referred to as "evenly-spaced peaks"). Next, when it is determined that there is no peak of other auto-correlation values between the evenly-spaced peaks of the auto-correlation value, the siren sound determination unit 23 determines whether or not the intervals between the evenly-spaced peaks of the correlation value are within a range of a siren cycle threshold that is assumed as the cycle of a siren sound. Next, when it is determined that the intervals between the evenly-spaced peaks of the correlation value is within the range of the siren cycle threshold, the siren sound determination unit 23 determines the signal level. Then, when the determined signal level is larger than a siren sound level threshold, the siren sound determination unit 23 determines that a siren sound is included in the input signal and hence sets a siren sound mode signal to a siren sound lock mode. Note that for the sake of ease, the presence/absence of a siren sound may be determined by determining only whether or not peaks of an auto-correlation value are located at regular intervals.

Note that the siren sound determination unit 23 preferably sets the siren sound mode signal to the siren sound lock mode when the period during which it is determined that a siren sound is included in the input signal continues for a certain period or longer. This is because if the siren sound mode signal is immediately changed to the siren sound lock mode based on the determination result that a siren sound is included in the input signal, a false determination that could possibly occur in the siren sound determination process would affect the overall process of the noise elimination device.

Next, the conversion separation unit 30 is explained. The conversion separation unit 30 operates upon receiving a siren sound mode signal that is in a siren sound lock mode. The conversion separation unit 30 divides an input signal, which is input as time-domain information, into suppression target band information including frequency domain information of a siren sound band as the main component and intended sound band information including frequency domain information other than the siren sound band as the main component, and outputs the divided information pieces.

More specifically, the conversion separation unit 30 includes a frequency conversion unit 31 and a signal separation unit 32. The frequency conversion unit 31 converts the input signal in the form of time-domain information into frequency-domain information and thereby outputs input frequency information. Examples of a signal conversion method used in the frequency conversion unit 31 include a method using a sub-band filter composed of a plurality of band-pass filters and a method using signal processing such as an FFT (Fast Fourier Transform).

The signal separation unit 32 divides the input frequency information into suppression target band information including information on the frequency band of a siren sound mixed in the input signal as the main component and intended sound band information including information other than the frequency band of the cyclic noise as the main component. The signal separation unit 32 includes a siren sound band analysis unit 32*a* and a band dividing unit 32*b*.

Figure 2:
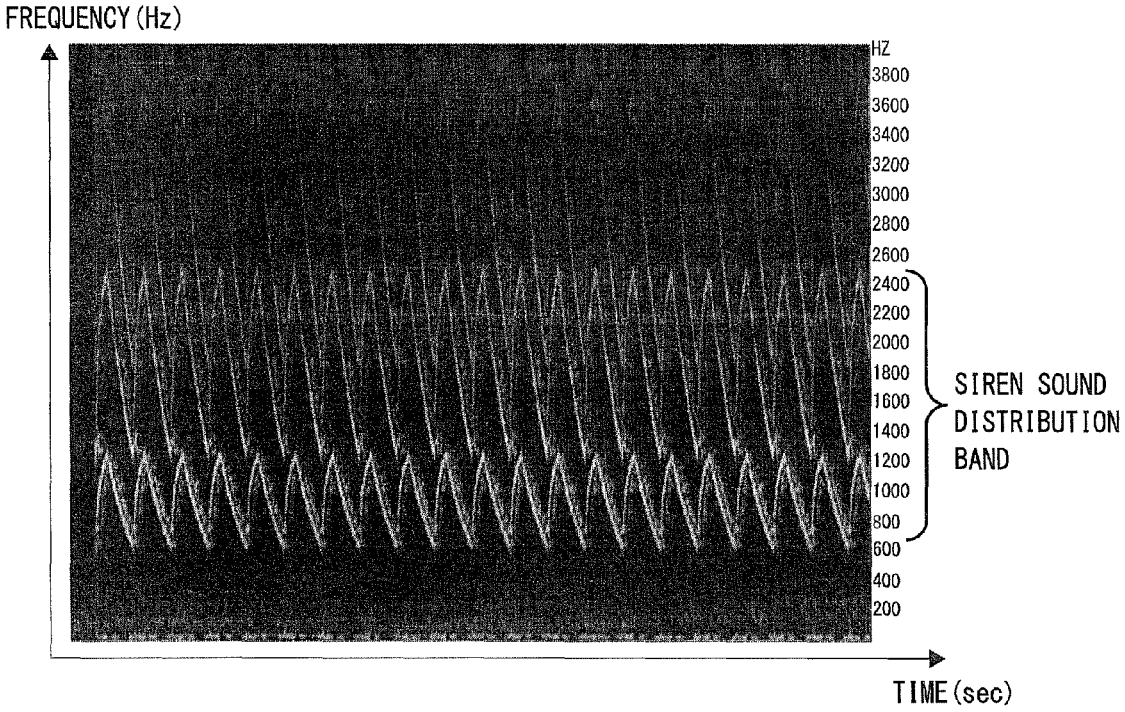
FIG. 2 is a first example of a spectrogram showing frequency changes over time of an input signal input to the noise elimination device according to the first exemplary embodiment.
Figure 3:
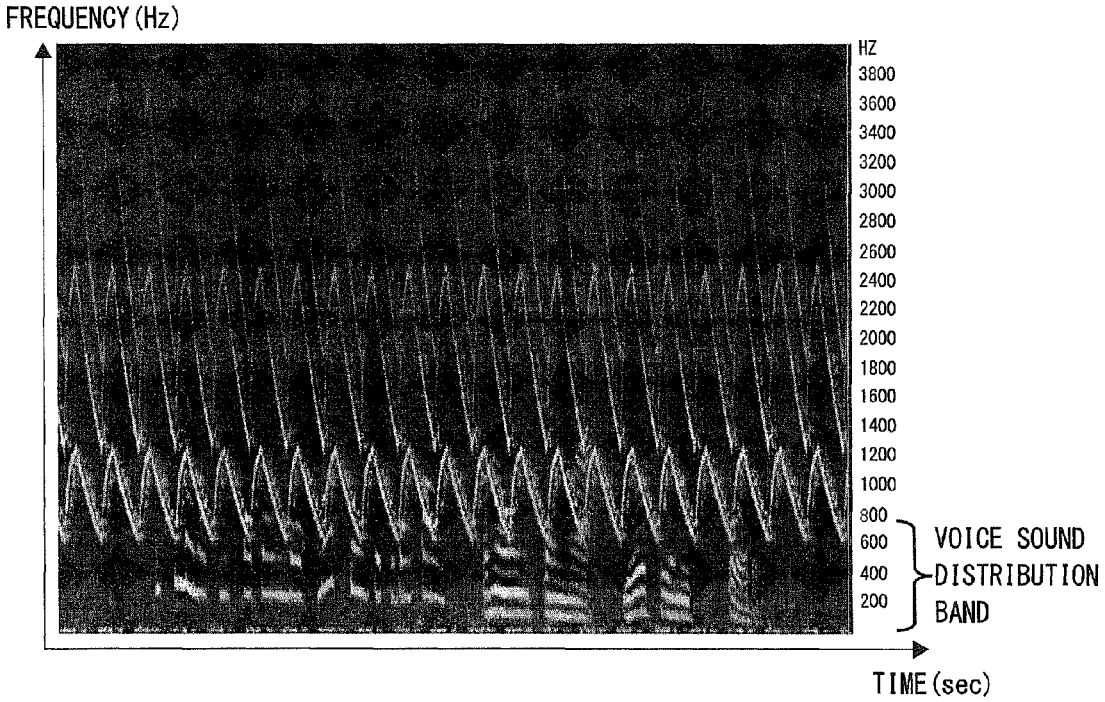
FIG. 3 is a second example of a spectrogram showing frequency changes over time of an input signal input to the noise elimination device according to the first exemplary embodiment.

The siren sound band analysis unit 32*a* analyzes the input frequency information and thereby recognizes a frequency band in which the siren sound is mainly distributed and a frequency band in which the intended sound is mainly distributed. Here, in order to explain an operation of the siren sound band analysis unit 32*a*, FIGS. 2 and 3 show spectrograms showing frequency changes over time of an input signal input to the noise elimination device 1 according to the first exemplary embodiment. FIG. 2 is a spectrogram for a case where only a siren sound is included in the input signal. FIG. 3 is a spectrogram for a case where a siren sound and an intended sound are included in the input signal. Further, in FIGS. 2 and 3, the depth of the color indicates the signal level in such a manner that the deeper the white the higher the signal level. Further, in FIGS. 2 and 3, the horizontal axis represents time and the vertical axis represents frequencies.

As shown in FIG. 2, it can be understood from the sound pressure level distribution that the main frequency components of the siren sound are present in a certain band. Further, as shown in FIG. 3, though depending on the type of the siren sound, the low-order harmonic components of a voice including its basic frequency, which is the main component of the voice, are often present outside the frequency band within which the frequency of the siren sound changes. In the suppression process using an adaptive filter and using an own (siren sound) signal as a reference signal (which will be described later), the presence of a signal(s) other than the own signal could lower the suppression effect. Further, there is another problem that when the signal other than the own signal is a voice, a possibility of an erroneous operation in which the voice could be suppressed arises. Further, there is a possibility of a situation arising where the clarity of the voice significantly deteriorates due to a voice signal involving a phase shift. To avoid such problems, it is necessary to prevent the mixing of a voice component into the reference signal as much as possible.

The siren sound distribution frequency band can be derived, by a frequency analysis, from an energy distribution that is obtained by smoothing the frequency band within which the frequency of the siren sound changes in the temporal direction. FIG. 2 shows an example of a siren sound frequency distribution graph. A siren sound frequency band can be specified by setting a certain signal level threshold and extracting a band for which the level ratio between a frequency band higher than that threshold and its adjacent frequency band is within a predetermined range. Although siren sounds differ in their frequency changing rates (i.e., they may have faster changing rates and slower changing rates), they are continuous in terms of the time, and siren sounds are often distributed in a specific frequency band. Even if there is a signal source other than the siren sound outside the siren sound band, it has a narrow band distribution. Therefore, it is possible to eliminate the signal since its level ratio with an adjacent band is high. For example, the sound pressure level of a voice signal shown in FIG. 3 is high only in the part where the spectrum of the voice is present. Therefore, it is categorized as a narrow band. Accordingly, the voice signal is not determined to be a siren sound. Further, a siren sound has such a characteristic that its duration is long. Therefore, the smoothing in the temporal direction enables a more accurate siren sound determination. Further, since low energy components are excluded from the components to be examined by the use of the level threshold, there is no need to take account of the influence of environmental noises whose sound pressure level is relatively low.

The band dividing unit 32*b* divides the input frequency information into suppression target band information including information on the frequency band of a siren sound mixed in the input signal as the main component and intended sound band information including information other than the frequency band of the cyclic noise as the main component based on the analysis result of the siren sound band analysis unit 32*a*, and outputs these divided information pieces.

Next, the noise suppression unit 40 is explained. The noise suppression unit 40 converts the suppression target band information into time-domain information and thereby outputs a suppression target signal. Further, the noise suppression unit 40 converts the intended sound band information into time-domain information and thereby outputs an intended sound signal. Next, the noise suppression unit 40 accumulates the suppression target signal and thereby stores noise history information including information corresponding to at least one cycle of the siren sound. Further, the noise suppression unit 40 artificially reproduces the suppression target signal by using the noise history information as a reference signal, and generates a suppression signal having a reverse relation to the suppression target signal. Then, the noise suppression unit 40 outputs a difference value between the suppression signal and the suppression target signal as a residual signal. Further, the noise suppression unit 40 combines the residual signal with the intended sound signal and thereby generates an output signal So. As shown in FIG. 1, the noise suppression unit 40 includes a first frequency reverse-conversion unit (e.g., a siren sound band frequency reverse-conversion unit 41), a second frequency reverse-conversion unit (e.g., a non-siren sound band frequency reverse-conversion unit 42), a reference information control unit 43, a siren sound storage unit 44, a reference buffer 45, a noise filter 46, and an adder 47.

The siren sound band frequency reverse-conversion unit 41 converts the suppression target band information output by the band dividing unit 32*b* into time-domain information and thereby outputs a suppression target signal. Although this suppression target signal includes a voice component remaining therein, which is a component of the intended sound signal present in the part where the band of the suppression target signal overlaps that of the intended sound signal, the strong components of the voice signal have been lowered by the effect of the band-pass filter. The non-siren sound band frequency reverse-conversion unit 42 converts the intended sound band information output by the band dividing unit 32*b* into time-domain information and thereby outputs an intended sound signal.

The reference information control unit 43 indicates an appropriate range of the noise history information stored in the siren sound storage unit 44, which serves as the cyclic noise information storage unit, based on the frequency information of the cyclic nose output by the siren sound determination unit 23. This indication about the range of the noise history information includes information about the time width corresponding to one cycle of the siren sound and information about the cut-out position of the noise history information stored in the siren sound information storage unit 44.

The siren sound information storage unit 44 accumulates the suppression target signal including the siren sound, and thereby stores noise history information having a length corresponding to at least one cycle of the siren sound. Note that every time a new suppression target signal is input, the siren sound storage unit 44 discards the oldest suppression target signal and adds the new suppression target signal to the noise history information.

The reference buffer unit 45 holds the noise history information output from the siren sound information storage unit 44 as a reference signal. Specifically, the reference buffer unit 45 temporarily stores the signal that the siren sound information storage unit 44 has output based on the noise information cut-out position indicated by the reference information control unit 43 as a reference signal.

The noise filter 46 artificially reproduces a suppression target signal by using the noise history information as a reference signal, and generates a suppression signal having a reverse relation to the suppression target signal and outputs a difference value between the suppression signal and the suppression target signal as a residual signal. More specifically, the noise filter 46 includes an adaptive filter unit 46*a* and an adder 46*b*.

The adaptive filter unit 46*a* is, for example, a filter circuit such as an FIR (Finite Impulse Response) filter. The adaptive filter unit 46*a* generates a suppression signal based on the reference signal. The adder 46*b* outputs a residual component between the suppression signal and the input signal. In this adder 46*b*, the suppression signal output from the adaptive filter unit 46*a* is input to its inverting input terminal. That is, the adder 46*b* substantially functions as a subtracter that subtracts the suppression signal component from the input signal. Further, the adder 46*b* also outputs the residual component to the adaptive filter unit 46*a*. The adaptive filter unit 46*a* shapes the waveform of the suppression signal based on this residual component. More specifically, the adaptive filter unit 46*a* controls a filter coefficient(s) used inside the adaptive filter unit 46*a* based on the residual component so that the waveform of the suppression closely resembles that of the input signal. This adaptive filter unit 46*a* is a filter that converts a past input signal series, which is input as a reference signal, into a pseudo-input signal.

Figure 4:
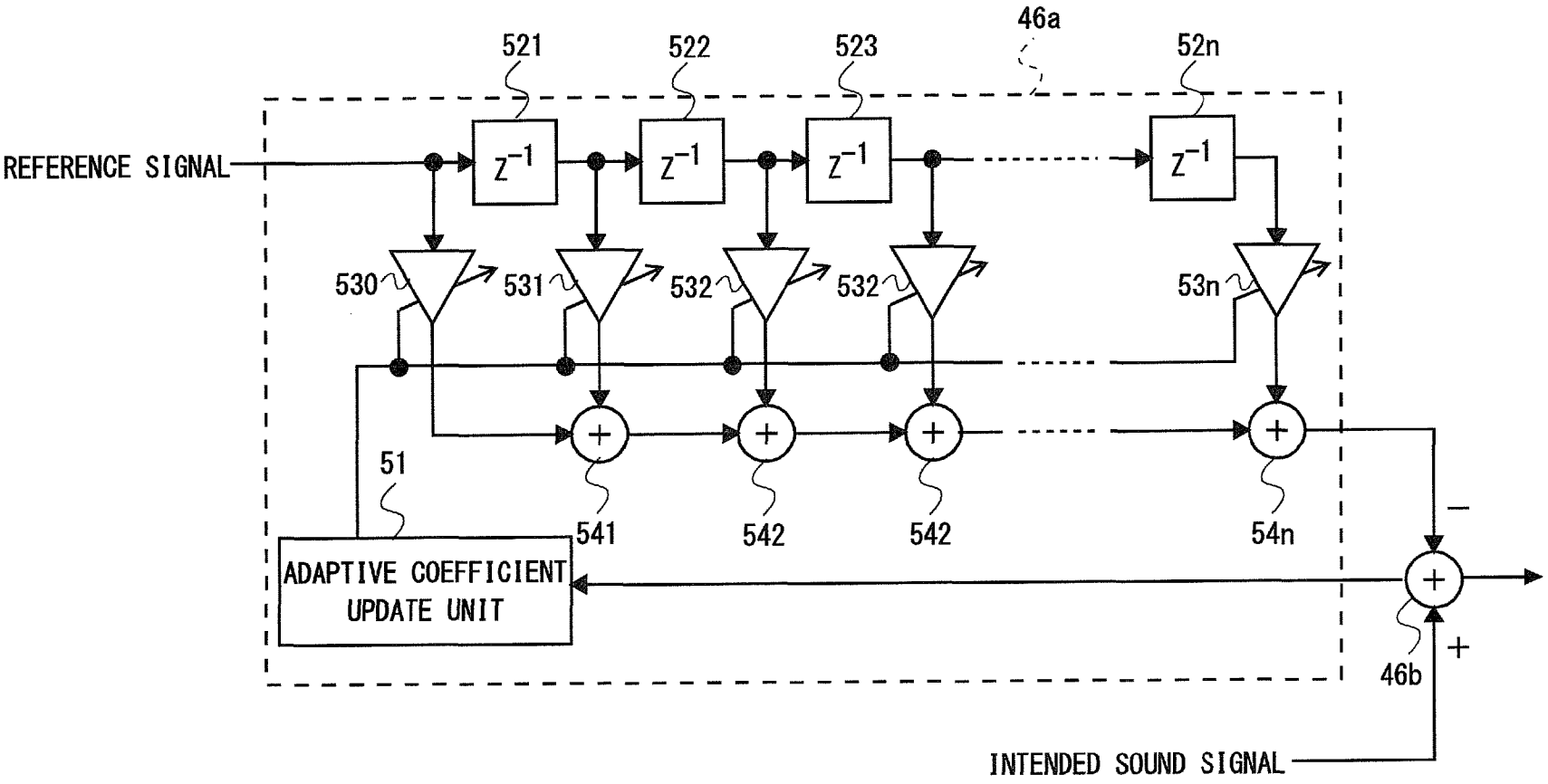
FIG. 4 is a block diagram of an adaptive filter unit according to the first exemplary embodiment.

FIG. 4 shows an example of a block diagram of the adaptive filter unit 46*a* and the adaptive filter unit 46*a* is explained hereinafter in a more detailed manner with reference to FIG. 4. As shown in FIG. 4, the adaptive filter unit 46*a* includes an adaptive coefficient update unit 51, delay circuits 521 to 52*n*, variable gain amplifiers 530 to 53*n*, and adders 541 to 54*n*. Note that n is an integer indicating a component number.

The delay circuits 521 to 52*n* are connected in series. Further, the variable gain amplifier 530 amplifies a reference signal by a predetermined gain and outputs the amplified signal to the adder 541. The variable gain amplifiers 531 to 53*n* amplify the outputs of the delay circuits 521 to 52*n* by predetermined gains and outputs the amplified signals to the adders 541 to 54*n*. Each of the adders 542 to 54*n* adds the output of the preceding adder and a respective one of the variable gain amplifiers 532 to 53*n*. Then, the output of the adder 54*n* disposed at the last stage used as the suppression signal.

The adaptive coefficient update unit 51 refers to a residual signal output by the adder 46*b* and thereby updates the gains of the variable gain amplifiers 530 to 53*n*. The gains of these variable gain amplifiers correspond to the filter coefficient of the adaptive filter unit 35*a*. The adder 47 combines the intended sound signal output from the non-siren sound band frequency reverse-conversion unit 42 with the residual signal output from the noise filter 46, and thereby outputs an output signal.

Figure 5:
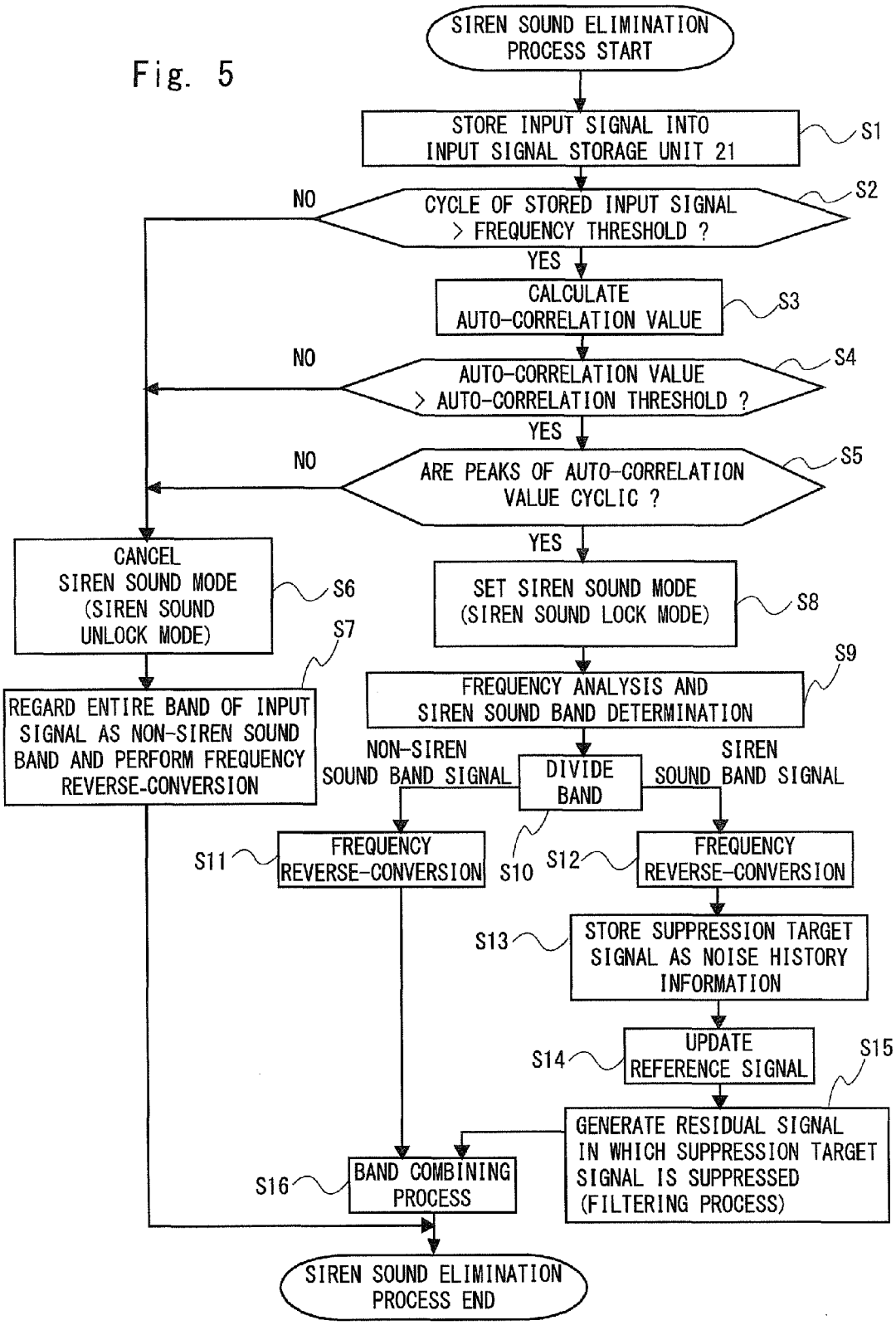
FIG. 5 is an operation flowchart of a noise elimination device according to the first exemplary embodiment.

Next, an operation of the noise elimination device 1 according to the first exemplary embodiment is explained. FIG. 5 shows an operation flowchart of the noise elimination device 1 according to the first exemplary embodiment. The flowchart shown in FIG. 5 shows a series of processes performed when one input signal is input. The noise elimination device 1 performs the series of processes shown in FIG. 5 for each frame of the input signal.

As shown in FIG. 5, every time an input signal is input, the noise elimination device 1 stores the input signal into the input signal storage unit 21 (step S1). Then, upon storing the input signal into the input signal storage unit 21, the auto-correlation value calculation unit 22*a* determines whether or not the number of cycles of the input signal stored in the input signal storage unit 21 is larger than a cycle number threshold (step S2). This cycle number threshold indicates a time width necessary for obtaining the cyclic nature of a siren sound. For example, one cycle of a siren sound whose frequency change over time is large is 80 msec to 300 msec. Therefore, when the one cycle of a siren sound is defined from 80 msec to 300 msec, the cycle number threshold is set to a value at least two times as large as this cycle. The cycle number threshold is not limited to the value two times as large as one cycle of the siren sound. That is, the cycle number threshold may be set to any integer that is an integral multiple of one cycle of the siren sound.

In the step S2, when it is determined that input signals larger than the cycle number threshold have not been accumulated yet in the input signal storage unit 21, the siren sound determination unit 23 sets a siren sound mode signal to a siren sound unlock mode indicating that no siren sound has been detected (step S6). Then, in response to the change of the siren sound mode signal to the siren sound unlock mode in the step S6, the conversion separation unit 30 regards the entire band of the input signal as a non-siren sound band, and the noise elimination device 1 generates an intended sound signal through a frequency reverse-conversion and outputs this intended sound signal as an output signal So (step S7). Note that when the siren sound mode signal is set to the siren sound unlock mode in the step S6, the operations of the reference information control unit 43, the siren sound storage unit 44, and the reference buffer 45 may be stopped. By stopping the operations of these components in the siren sound unlock mode, the power consumption of the noise elimination device 1 can be reduced.

On the other hand, when it is determined that input signals larger than the cycle number threshold have been accumulated in the input signal storage unit 21 in the step S2, the auto-correlation value calculation unit 22*a* calculates an auto-correlation value(s) based on the above-shown Expression (1) or the like (step S3). Then, the correlation value analysis unit 22*b* analyzes the auto-correlation value(s) and thereby determines whether or not there is an auto-correlation value larger than an auto-correlation threshold (step S4). When it is determined that there is no auto-correlation value larger than the auto-correlation threshold in this step S4, the siren sound determination unit 23 performs the processes in the steps S6 and S7 and the noise elimination device 1 temporarily terminates the siren sound elimination process. On the other hand, when it is determined that there is an auto-correlation value larger than the auto-correlation threshold in this step S4, the correlation value analysis unit 22*b* outputs the positions and the intervals of peaks of the auto-correlation value to the siren sound determination unit 23 and the siren sound determination unit 23 determines the presence/absence of a siren sound.

As a step S5 subsequent to the step S4, the siren sound determination unit 23 determines whether or not there are auto-correlation values (peaks of auto-correlation values) that are larger than the auto-correlation threshold and located at regular intervals. When it is determined that the peaks of the auto-correlation value are not located at regular intervals in the step S5, the siren sound determination unit 23 performs the processes in the steps S6 and S7 and the noise elimination device 1 temporarily terminates the siren sound elimination process. On the other hand, when it is determined that the peaks of the auto-correlation value are located at regular intervals in the step S5, the siren sound determination unit 23 determines that a siren sound is included in the input signal and hence sets the siren sound mode signal to a siren sound lock mode (step S8). Note that although FIG. 5 shows a case where a simple process is performed as a siren sound detection process, a more strict determination process may be performed based on the magnitude, the interval, and/or the like of peaks of an auto-correlation value(s) as described previously.

Next, the noise elimination device 1 analyzes the input frequency information generated based on the input signal in the conversion separation unit 30, and thereby determines a siren sound band in which the siren sound is distributed (step S9). Then, the conversion separation unit 30 generates suppression target band information (e.g., siren sound band signal) and intended sound band information (e.g., non-siren sound band signal) from the input frequency information based on the result in the step S9 (step S10).

Then, the noise suppression unit 40 generates an intended sound signal by performing a frequency reverse-conversion process for the intended sound band information (step S11). Further, the noise suppression unit 40 generates a suppression target signal by performing a frequency reverse-conversion process for the suppression target band information (step S12). Then, subsequent to this step S12, the noise suppression unit 40 stores the suppression target signal into the siren sound storage unit 44 as noise history information (step S13). After that, the noise suppression unit 40 updates the reference signal by the noise history information stored in the siren sound storage unit 44 (step S14). Then, the noise suppression unit 40 performs a filtering process for lowering the signal level of the suppression target signal by using the noise filter 46, and thereby outputs a residual signal indicating a difference between the suppression signal and the suppression target signal (step S15). The noise suppression unit 40 combines the intended sound signal generated in the step S11 with the residual signal generated in the step S15, and thereby outputs an output signal So (step S16).

As explained above, in the noise elimination device 1 according to the first exemplary embodiment, a reference signal that is used to generate a suppression signal is generated from the suppression target signal including no or few voice signal components obtained from a preceding input signal(s) that has been input before the current input signal. As a result, the noise elimination device 1 according to the first exemplary embodiment does not need to hold any information for the reference signal in advance and is able to perform a highly accurate siren sound elimination process according to the characteristic of the cyclic noise mixed in the input signal without depending on the cyclic nature of the cyclic noise.

Further, in the noise elimination device 1 according to the first exemplary embodiment, the output signal is output by combining the intended sound signal obtained by cutting out a signal having a certain frequency band with the residual signal in which a siren sound component is suppressed in the noise filter 46. As a result, the noise elimination device 1 according to the first exemplary embodiment can prevent the voice signal from deteriorating due to the suppression process. More specifically, a part of the intended sound signal included in the suppression target signal including the siren sound as the main component is output as a residual signal. Then, by adding the residual signal with the intended sound signal in the adder 47, the noise elimination device 1 can restore the signal that satisfies the original frequency band. Further, in the noise elimination device 1, because of the presence of the non-siren sound band that is not affected by the siren sound suppression process, the integrity of a signal, in particular, a signal for which clarity is indispensable such as a voice signal is maintained.

Further, the noise elimination device 1 according to the first exemplary embodiment generates an auto-correlation value between the current input signal and a preceding input signal(s) input in the past based on the current input signal and the preceding input signal(s), and detects a siren sound by paying attention to the cyclic nature of peaks of the auto-correlation value. In this way, the noise elimination device 1 according to the first exemplary embodiment can detect a siren sound with high direction accuracy. This advantageous effect is explained hereinafter with reference to graphs showing frequency changes of input signals over time and signal level changes thereof over frequencies shown in FIGS. 6 and 7.

Figure 6A:
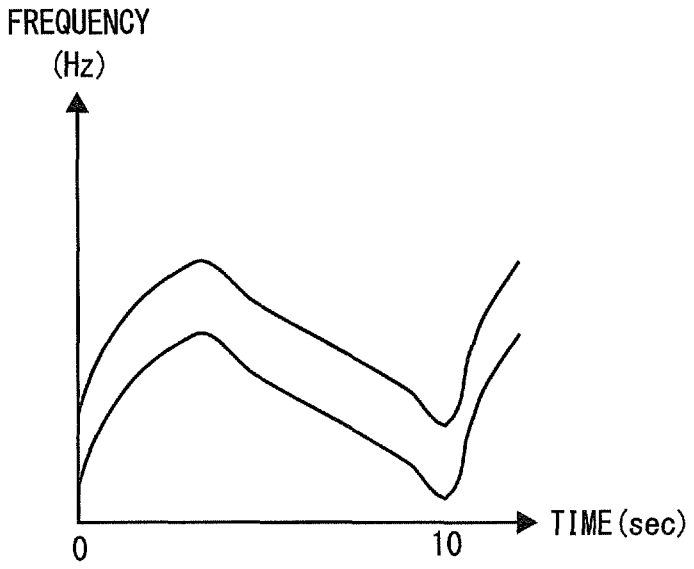
FIGS. 6A and 6B show graphs showing a first example of frequency changes of a siren sound over time and signal level changes of over frequencies.
Figure 6B:
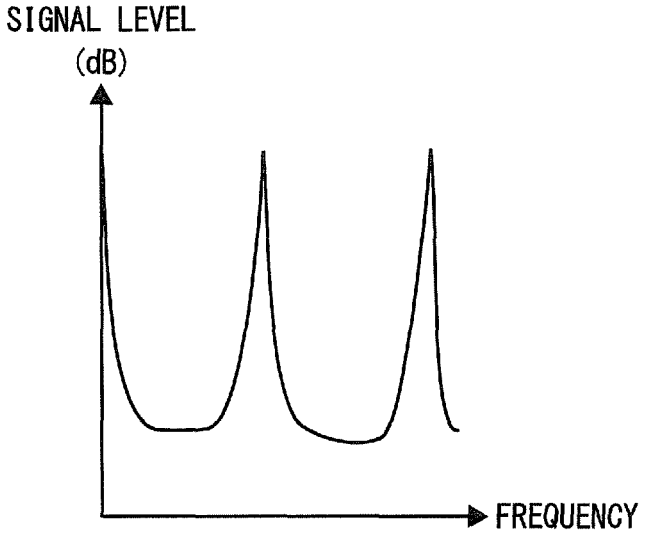
Figure 7A:
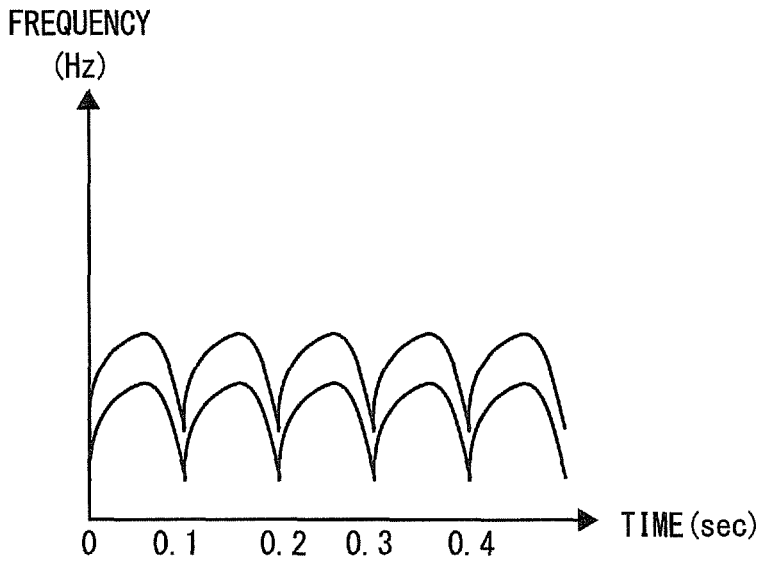
FIGS. 7A and 7B show graphs showing a second example of frequency changes of a siren sound over time and signal level changes of over frequencies.
Figure 7B:
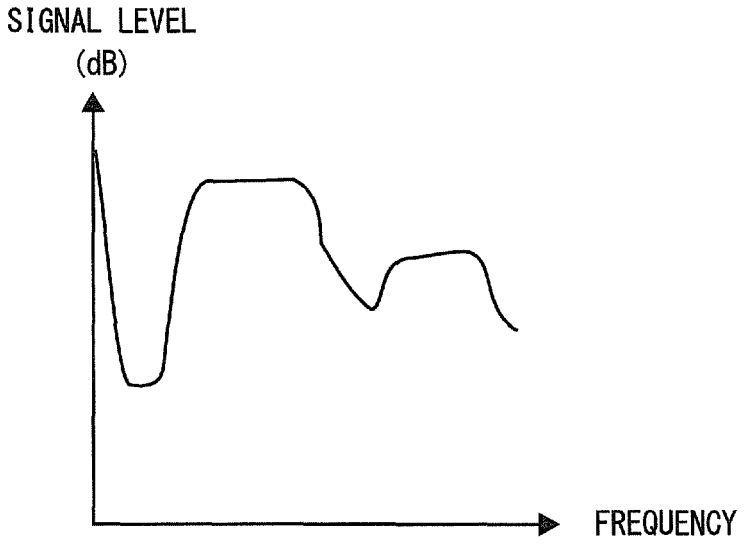

An example shown in FIGS. 6A and 6B show an example of an input signal whose frequency changes over time is relatively gentle. An example shown in FIGS. 7A and 7B show an example of an input signal whose frequency changes over time is relatively sharp. As shown in FIGS. 6A and 6B, when the frequency changes over time are relatively gentle, the dependence of the signal level on the frequency is high. Therefore, it is relatively easy to determine the presence/absence of a cyclic noise based on the signal level by converting the time-domain input signal into a frequency-domain signal. In contrast to this, as shown in FIGS. 7A and 7B, when the frequency changes over time are relatively sharp, the dependence of the signal level on the frequency is low. Therefore, it is relatively difficult to determine the presence/absence of a cyclic noise based on the signal level even when the time-domain input signal is converted into a frequency-domain signal. However, since the auto-correlation value based on the time-domain signal uses a correlation value between a preceding input signal(s) input in the past and the current input signal for the determination of the presence/absence of a cyclic noise, the above-described problem does not occur.

Further, in prior art, in communication in mobile communication, background noises and noises whose frequency characteristic and power vary over time such as a high-speed changing type siren sound have adverse effects on the voices, thus making hearing the voices very difficult. In the prior-art spectral subtraction method, the noise/elimination method in a frequency range, and the SPAC method, there is a limit on the improvement of the performance due to the problems such as a frequency resolution, a process delay, and signal discontinuity. In contrast to this, the noise elimination device 1 according to the first exemplary embodiment can accurately determine peak positions of an auto-correlation result and the presence/absence of a high-speed changing type siren sound (having a short cycle of frequency changes) from a peak section(s). Further, information corresponding to one cycle of a siren sound can be appropriately managed from the cycle of a detected siren sound and the information of voice section determination.

Second Exemplary Embodiment

Figure 8:
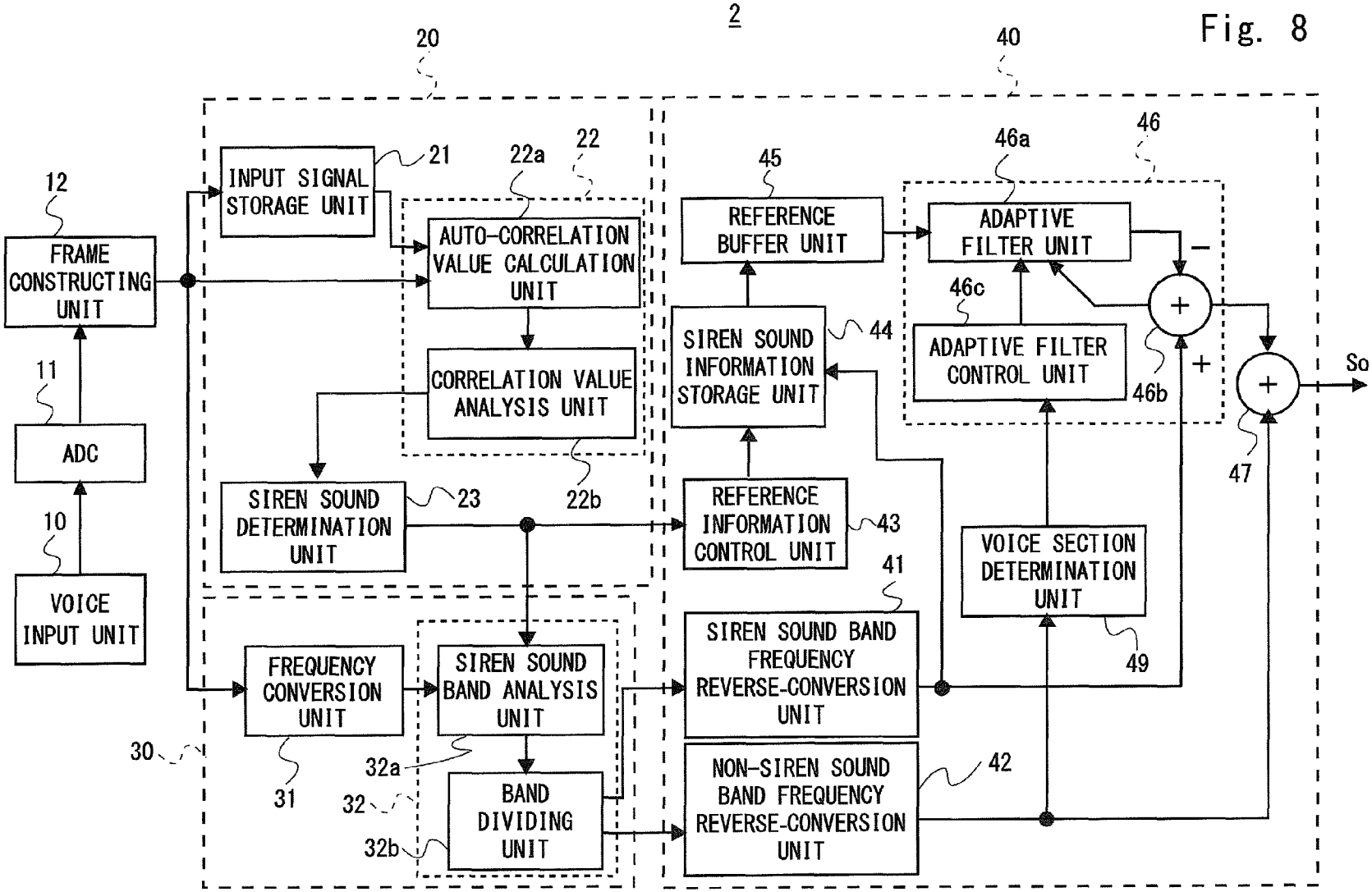
FIG. 8 is a block diagram of a noise elimination device according to a second exemplary embodiment.

In a second exemplary embodiment, a noise elimination device 2, which is a modified example of the noise elimination device 1 according to the first exemplary embodiment, is explained. Therefore, FIG. 8 shows a block diagram of the noise elimination device 2 according to the second exemplary embodiment. Note that in the following explanation of the second exemplary embodiment, components of said embodiment which are the same as components of the first exemplary embodiment already explained above are assigned the same symbols as those assigned to the same components of the first exemplary embodiment and thus their explanations are omitted.

As shown in FIG. 8, the noise elimination device 2 according to the second exemplary embodiment is obtained by replacing the noise filter 46 of the noise suppression unit 40 with a noise filter 48 and adding a voice section determination unit 49 in the first exemplary embodiment. The noise filter 48 is obtained by adding an adaptive filter control unit 46*c* in the noise filter 46.

The voice section determination unit 49 brings a voice section signal into an enabled state when a voice signal component included in the intended sound signal output by the non-siren sound band frequency reverse-conversion unit 42 is larger than a voice threshold level. That is, the voice section determination unit 49 analyzes a signal component(s) included in the input signal and thereby determines whether or not a voice signal component is included in the input signal. In the second exemplary embodiment, since no siren sound component, which is a noise component, is included in the intended sound signal, it is expected that the accuracy of the determination on whether it is in a voice section or not will improve. For this analysis method, for example, a method for determining a voice signal component based on a spectrum component(s) of an input signal disclosed in Japanese Unexamined Patent Application Publication No. 2012-128411, which has already been filed by the inventors of the present application, can be used.

In response to the change of the voice section signal to the enabled state, the adaptive filter control unit 46*c* outputs a filter control signal for lowering the convergence speed of the adaptive filter unit 46*a*. This filter control signal is input to, for example, the adaptive coefficient update unit 51 shown in FIG. 4. When the adaptive filter unit 46*a* is instructed to lower the convergence speed by the control signal, the adaptive filter unit 46*a* changes a filter coefficient so that the reflection amount of the residual signal output by the adder 46*b* is reduced.

The problem that can be solved by the noise elimination device 2 according to the second exemplary embodiment is explained hereinafter. In the noise elimination device 2, the operation of the adaptive filter for artificially generating a siren sound to be suppressed is performed so as to approximate the current signal including the voice signal component due to the effect of the voice signal in the part where the frequency component of the voice overlaps that of the siren sound. As a result, the suppression signal output by the adaptive filter unit 46*a* has a lower siren sound suppression effect in comparison to that of the suppression signal that is generated based solely on the siren sound. Further, a phenomenon resembling a sound effect such as an echo and a reverb could occur due to the mixture of a voice component into the suppression signal output by the adaptive filter unit 46*a*, thus causing a possibility that the clarity of the voice in the final output signal deteriorates. In the noise elimination device 2 according to the second exemplary embodiment, the main component band of the voice is divided and separated from the siren sound suppression process path as described previously. Therefore, although the integrity of the voice signal is maintained, there is still a risk of deterioration when a large quantity of voice signal components are included in the band where the voice signal overlaps the siren sound.

The above-described problem to be solved lies in the working in the operation process of the adaptive filter unit 46*a* in which the voice signal that appears as the residual is involved in the adaptation and the filter coefficient is adjusted so that the residual component is minimized To avoid this problem, in the second exemplary embodiment, the convergence speed of the adaptive filter unit 46*a* is relaxed in the voice signal section by using the adaptive filter control unit 46*c* and the voice section determination unit 49.

More specifically, in the second exemplary embodiment, the adaptive filter control unit 46*c* controls the coefficient value of an acceleration coefficient that indicates whether the suppression target signal should be adapted at a high speed or not in accordance with the voice section signal. When the input suppression target signal is mainly composed of components of a siren sound, the acceleration coefficient is increased in order to increase the suppression effect of the current suppression target signal. On the other hand, when a component(s) other than the siren sound, in particular, a voice component(s) is mixed in the suppression target signal, the acceleration coefficient is lowered and the adaptation to the current suppression target signal is thereby relaxed in order to facilitate the operation for avoiding the effect of the filtering process on the voice.

Figure 9:
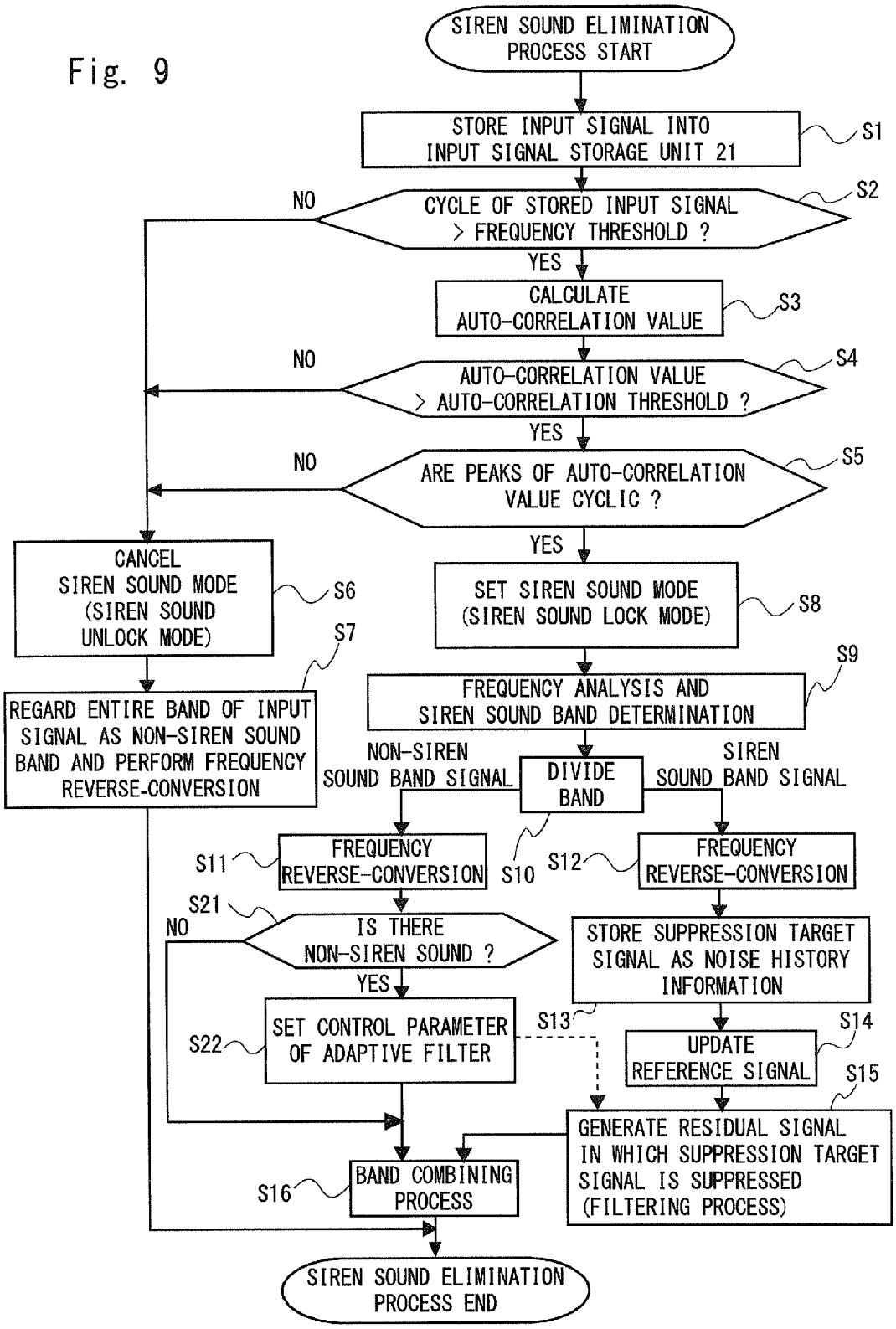
FIG. 9 is an operation flowchart of a noise elimination device according to the second exemplary embodiment.

An operation of the noise elimination device 2 according to the second exemplary embodiment is explained hereinafter with reference to a flowchart. FIG. 9 shows an operation flowchart of the noise elimination device 2 according to the second exemplary embodiment. As shown in FIG. 9, in the noise elimination device 2 according to the second exemplary embodiment, processes in steps S21 and S22 are added between the steps S11 and S16 of the noise elimination device 1 according to the first exemplary embodiment.

In the step S21, the voice section determination unit 49 makes a decision on the voice section. In this voice section determination, it is determined whether or not a voice signal component is included in the intended sound signal. When no voice signal component is included in the intended sound signal in this step S21, the process in the step S22 is not performed. In the step S22, the adaptive filter control unit 46*c* sets a control parameter(s) of the adaptive filter unit 46*a*. More specifically, in the step S22, the adaptive filter control unit 46*c* changes a control parameter(s) in order to relax the convergence speed of the adaptive filter unit 46*a*.

As explained above, the noise elimination device 2 according to the second exemplary embodiment can clarify the voice signal even further by preventing an erroneous operation of the adaptive filter unit 46*a* based on the voice section determination process using an intended sound signal including no siren sound.

Third Exemplary Embodiment

Figure 10:
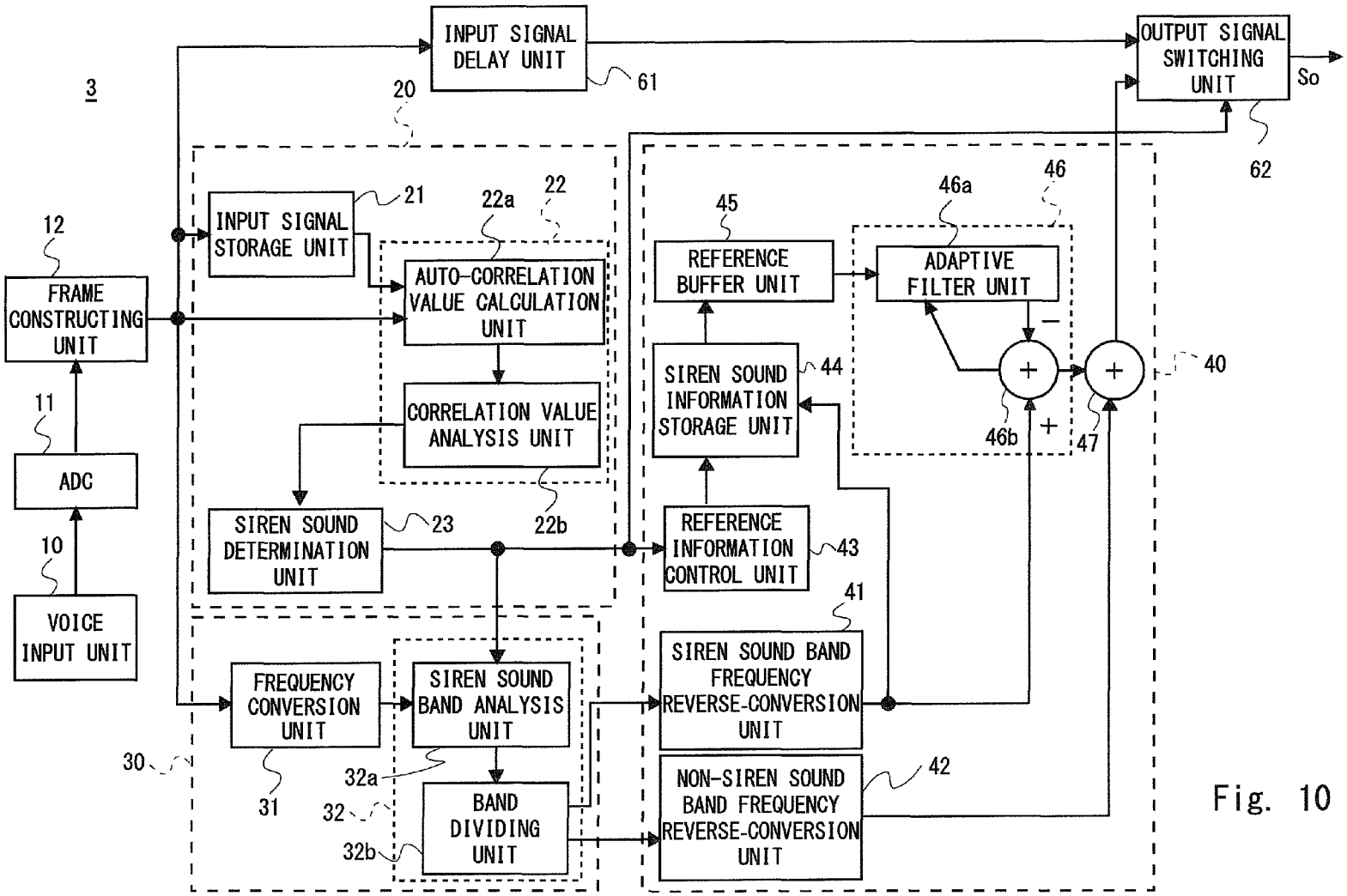
FIG. 10 is a block diagram of a noise elimination device according to a third exemplary embodiment.

In a third exemplary embodiment, a noise elimination device 3, which is a modified example of the noise elimination device 1 according to the first exemplary embodiment, is explained. Therefore, FIG. 10 shows a block diagram of the noise elimination device 3 according to the third exemplary embodiment. Note that in the following explanation of the third exemplary embodiment, the same symbols are assigned to the components that are already explained above in the first exemplary embodiment and their explanations are omitted.

As shown in FIG. 10, the noise elimination device 3 according to the third exemplary embodiment is obtained by adding an input signal delay unit 61 and an output signal switching unit 62 in the noise elimination device 1 according to the first exemplary embodiment. The input signal delay unit 61 delays the input signal by a time corresponding to the time that is taken from when the input signal is input to when that input signal is output as the output signal So. The output signal switching unit 62 selects and outputs the output signal of the noise suppression unit 40 when the siren sound mode signal is in a siren sound lock mode, and selects and outputs the input signal output from the input signal delay unit 61 when the siren sound mode signal is in a siren sound unlock mode.

Figure 11:
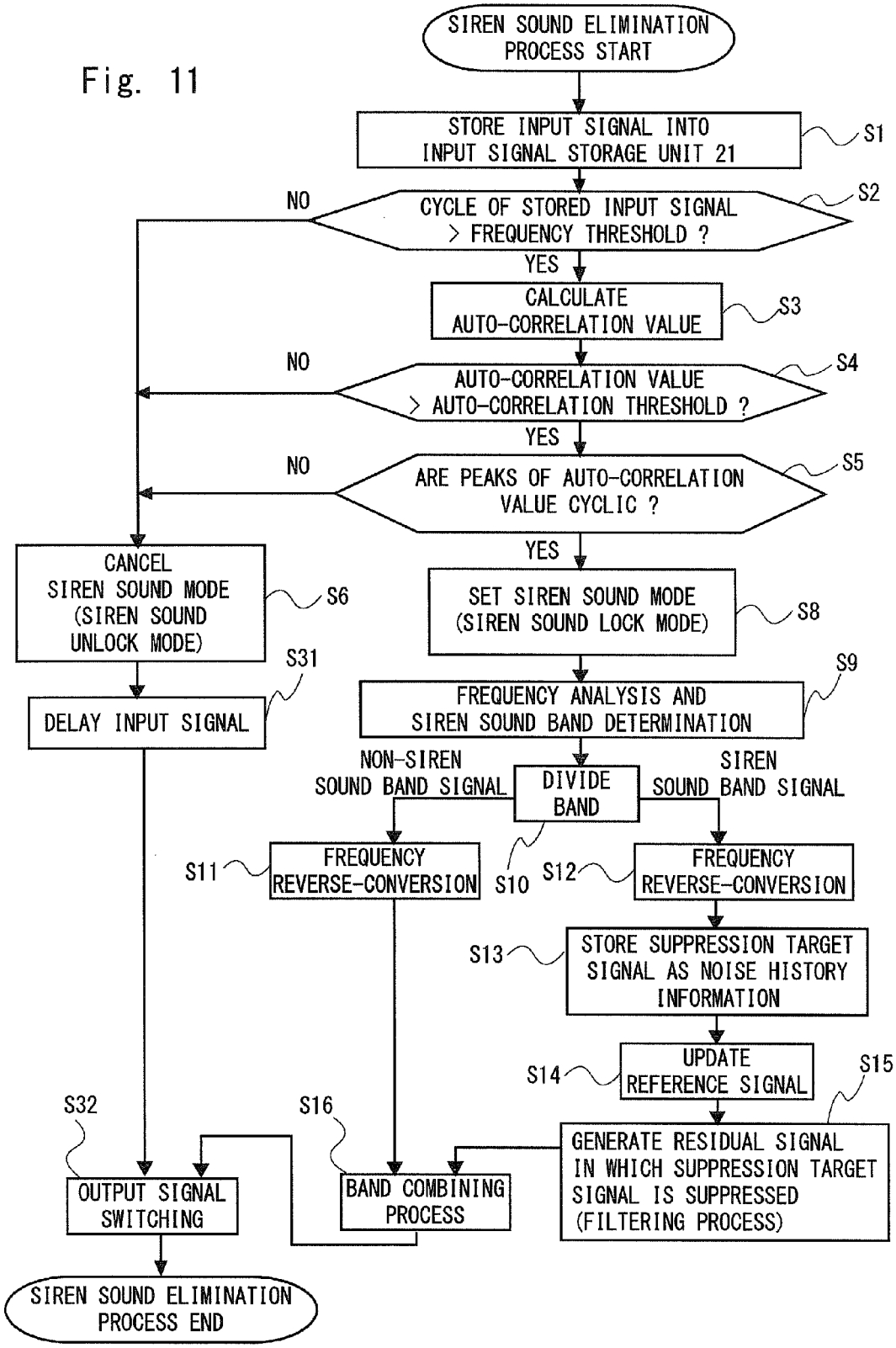
FIG. 11 is an operation flowchart of a noise elimination device according to the third exemplary embodiment.

Next, an operation of the noise elimination device 3 according to the third exemplary embodiment is explained. Therefore, FIG. 11 shows an operation flowchart of the noise elimination device 3 according to the third exemplary embodiment. As shown in FIG. 11, the noise elimination device 3 according to the third exemplary embodiment performs a step S31 instead of the output signal generation process in the step S7 performed by the noise elimination device 1 according to the first exemplary embodiment. Further, the noise elimination device 3 performs a step S32 after the step S31 or after the signal combining process in the step S16.

The step S31 is a process for delaying the input signal performed by the input signal delay unit 61. The step S32 is an output switching process in which when the siren sound mode signal is in a siren sound lock mode, the output signal of the noise suppression unit 40 is selected, whereas when the siren sound mode signal is in a siren sound unlock mode, the input signal output from the input signal delay unit 61 is selected.

In the noise elimination devices 1 and 2 according to the first and second exemplary embodiments, the operations of the adaptive filter, the frequency conversion unit, and so on are continued even in the situation where no siren sound is included in the input signal. However, some processes, in particular, the siren sound suppression process do not need to be performed in the time period during which no siren sound is mixed in the input signal. Therefore, it is desired to lighten the overall processing load according to the presence/absence of a siren sound.

Accordingly, in the third exemplary embodiment, the execution of the siren sound elimination process is controlled according to the determination result of the siren sound determination unit 23, which determines the presence/absence of a siren sound. In FIG. 10, for the sake of simplicity, an operation in which the final output signal is switched is shown.

However, components other than the voice input unit 10, the analog-digital converter 11, the frame constructing unit 12, and the noise detection unit 20, which are necessary for the operation of the siren sound determination unit 23, may be temporarily suspended according to the siren sound determination result.

There is a certain signal processing delay between the output signal output after the siren sound elimination process and the voice signal included in the input signal, which is caused through the siren sound elimination process. In the noise elimination device 3 according to the third exemplary embodiment, the input signal output from the input signal delay unit 61 is synchronized in terms of the time with the output signal output after the siren sound elimination process, which is the output signal of the noise suppression unit 40, by using the input signal delay unit 61. Therefore, the noise elimination device 3 according to the third exemplary embodiment can output a continuous output signal without interruption just by switching the output path according to the siren sound detection result.

As explained above, the noise elimination device 3 according to the third exemplary embodiment is able to suspend some of the functions of the siren sound elimination process when no siren sound is included in the input signal and thereby to reduce the overall load.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A noise elimination device comprising:

a frequency conversion unit configured to convert an input signal in a form of time-domain information into frequency-domain information and thereby outputs input frequency information;

a signal separation unit configured to divide the input frequency information into suppression target band information and intended sound band information, where a main component of the suppression target band information is a frequency band information of a cyclic noise mixed in the input signal, and a main component of the intended sound band information is information other than the frequency band of the cyclic noise;

a first frequency reverse-conversion unit configured to convert the suppression target band information into time-domain information and thereby output a suppression target signal;

a second frequency reverse-conversion unit configured to convert the intended sound band information into time-domain information and thereby output an intended sound signal;

a cyclic noise information storage unit configured to accumulate the suppression target signal and thereby stores noise history information including at least one cycle period of the cyclic noise;

a noise filter that artificially reproduces the suppression target signal by using the noise history information as a reference signal, and generates a suppression signal having a reversed relation to the suppression target signal and outputs a difference value between the suppression signal and the suppression target signal as a residual signal; and an adder that combines the residual signal with the intended sound signal and thereby generates an output signal.

2. The noise elimination device according to claim 1, further comprising a noise detection unit configured to output, upon detecting that the cyclic noise is included in a current input signal based on a correlation between the current input signal and a preceding input signal being input before the current input signal, a cyclic noise detection signal including cycle information of the cyclic noise and a siren sound mode signal which notifies detection of the cyclic noise, wherein the signal separation unit outputs the suppression target band information and the intended sound band information when the siren sound mode signal is in a siren sound lock mode indicating that the cyclic noise is being detected, and outputs the input frequency information as the intended sound band information when the siren sound mode signal is in a siren sound unlock mode indicating that the cyclic noise is not being detected.

3. The noise elimination device according to claim 2, further comprising a reference information control unit configured to indicate a range of noise history information to be output by the cyclic noise information storage unit based on the cycle information of the cyclic noise.

4. The noise elimination device according to claim 3, wherein the noise detection unit comprises:

an input signal storage unit configured to accumulate the current input signal and thereby stores the preceding input signal;

an auto-correlation unit configured to calculate an auto-correlation value between the current input signal and the preceding input signal and analyzes cycle information of the auto-correlation value larger than a predefined auto-correlation threshold; and a cyclic noise determination unit configured to determine whether or not the cyclic noise is included in the current input signal based on the cycle information, and when the cyclic noise is included in the current input signal, output the cycle information to the reference information control unit.

5. The noise elimination device according to claim 1, wherein the noise filter comprises:

an adaptive filter unit configured to generate the suppression signal based on the reference signal; and an adder that outputs a residual component between the suppression signal and the input signal as the output signal, wherein the adaptive filter is configured to shape a waveform of the suppression signal based on the residual component.

6. The noise elimination device according to claim 5, further comprising a voice section determination unit configured to set a voice section signal to an enabled state when a voice signal component included in the intended sound signal is higher than a predefined voice threshold level, wherein the noise filter further comprises an adoptive filter control unit configured to output a filter control signal for decreasing a convergence speed of the adaptive filter unit in response to a change of the voice section signal to the enabled state.

7. The noise elimination device according to claim 2, further comprising:

an input signal delay unit configured to delay the input signal by a time corresponding to a time for which the input signal is being output as the output signal; and an output signal switching unit configured to select and output the output signal when the siren sound mode signal is in a siren sound lock mode, and select and output the input signal output from the input signal delay unit when the siren sound mode signal is in a siren sound unlock mode.

8. A noise elimination method in a noise elimination device that suppresses a cyclic noise included in an input audio signal and outputs an output audio signal, the noise elimination method comprising:

converting an input audio signal in a form of time-domain information into frequency-domain information and thereby outputting input frequency information;

dividing the input frequency information into suppression target band information and intended sound band information, where a main component of the suppression target band information is a frequency band information of a cyclic noise mixed in the input signal, and a main component of the intended sound band information is information other than the frequency band of the cyclic noise;

converting the suppression target band information into time-domain information and thereby outputting a suppression target signal;

converting the intended sound band information into time-domain information and thereby outputting an intended sound signal;

accumulating the suppression target signal and thereby storing cyclic noise history information including at least one cycle period of the cyclic noise;

artificially reproducing the suppression target signal by using the cyclic noise history information as a reference signal, and generating a suppression signal having a reversed relation to the suppression target signal and outputting a difference value between the suppression signal and the suppression target signal as a residual signal; and combining the residual signal with the intended sound signal and thereby generating the output audio signal.

9. A non-transitory computer readable medium storing a noise elimination program executed by an arithmetic unit in a noise elimination device, the noise elimination device comprising the arithmetic unit and a storage unit and being configured to suppress a cyclic noise included in an input audio signal and output an output audio signal, the noise elimination program being adapted for causing a computer to execute:

a frequency conversion step of converting an input audio signal in a form of time-domain information into frequency-domain information and thereby outputting input frequency information;

a signal separation step of dividing the input frequency information into suppression target band information and intended sound band information, where a main component of the suppression target band information is a frequency band information of a cyclic noise mixed in the input signal, and a main component of the intended sound band information is information other than the frequency band of the cyclic noise;

a first frequency reverse-conversion step of converting the suppression target band information into time-domain information and thereby outputting a suppression target signal;

a second frequency reverse-conversion step of converting the intended sound band information into time-domain information and thereby outputting an intended sound signal;

a cyclic noise information storing step of accumulating the suppression target signal and thereby storing cyclic noise history information including at least one cycle period of the cyclic noise;

a noise filtering step of artificially reproducing the suppression target signal by using the cyclic noise history information as a reference signal, and generating a suppression signal having a reversed relation to the suppression target signal and outputting a difference value between the suppression signal and the suppression target signal as a residual signal; and an addition step of combining the residual signal with the intended sound signal and thereby generating the output audio signal.

* * * * *